US006413594B1

(12) United States Patent
Onishi

(10) Patent No.: US 6,413,594 B1
(45) Date of Patent: Jul. 2, 2002

(54) ANIMATED WIREFRAME WITH MOTOR

(75) Inventor: Yosuke Onishi, Hong Kong (HK)

(73) Assignee: Bite Star Limited, Kowloon (HK)

( * ) Notice: Subject to any disclaimer, the term of this patent is extended or adjusted under 35 U.S.C. 154(b) by 0 days.

(21) Appl. No.: 09/611,089

(22) Filed: Jul. 6, 2000

Related U.S. Application Data

(63) Continuation-in-part of application No. 09/458,324, filed on Dec. 10, 1999.

(30) Foreign Application Priority Data

Aug. 13, 1999 (CN) ..... 99219207 U

(51) Int. Cl.[7] ..... G09F 19/02

(52) U.S. Cl. ..... 428/7; 428/542.2; 40/414; 40/419

(58) Field of Search ..... 211/26, 26.1, 26.2; 40/429, 414, 419, 540; 446/358, 352, 353; 248/175; 428/7, 542.2

(56) References Cited

U.S. PATENT DOCUMENTS

| | | | | | |
|---|---|---|---|---|---|
| 547,553 | A | * | 8/1895 | Keller | 446/553 |
| 2,169,380 | A | * | 8/1939 | Barret | 40/418 |
| 4,676,764 | A | * | 6/1987 | Yeu | 446/298 |
| 4,867,730 | A | * | 9/1989 | Lee | 446/353 |
| 5,247,753 | A | * | 9/1993 | Yang | 40/414 |
| 5,379,202 | A | * | 1/1995 | Daun | 362/252 |
| 5,784,815 | A | * | 7/1998 | Hermanson | 40/414 |
| 5,850,927 | A | * | 12/1998 | Pan | 211/181.1 |
| 5,955,156 | A | * | 9/1999 | Hermanson | 428/7 |

* cited by examiner

*Primary Examiner*—Burton S. Mullins
(74) *Attorney, Agent, or Firm*—Ohlandt, Greeley, Ruggiero & Perle, LLP

(57) ABSTRACT

An electric device for a wireframe acting flexibly comprising a motor, a shaft connected to and driven by the motor, and a guide lever, the guide lever having a first end and a second end, the first end being connected to the shaft, the second end being connected to a final movable axle, the final movable axle having a non-fixed support arranged thereon. It also discloses a motor-driven wireframe arranged with an electric device.

10 Claims, 10 Drawing Sheets

ANIMATED WIREFRAME WITH MOTOR

RELATED APPLICATION

This application is a continuation-in-part of U.S. application Ser. No. 09/458,324 filed on Dec. 10, 1999.

BACKGROUND OF THE INVENTION

1. Field of the Invention

The present invention relates to a movable animated wireframe with a motor. Specifically, the present invention is particularly applied to a Christmas wireframe, but it is not limited to a Christmas wireframe.

2. Description of the Prior Art

An ordinary Christmas wireframe is merely stuck with color paper or arranged with bulbs, hence it appears inactive and lacks vitality.

SUMMARY OF THE INVENTION

An object of the present invention is to provide an electric device for a wireframe that can make the wireframe move or act. The wireframe structure is simple and its operation easy.

According to one aspect of the present invention, an electric device for a wireframe acting flexibly is characterized in that it comprises a motor, a shaft connected to and driven by the motor, a guide lever with one end connected to the shaft and another end thereof connected to a final movable axle. The final movable axle is connected to a balance weight, which has a non-fixed support arranged thereon.

In one embodiment of the present invention, the motor-driven wireframe has a general animal-like appearance. The wireframe may be made of metal, plastics, mylar or other suitable materials. It comprises a fixed part with a body and four limbs, and a movable part with a neck and a head. The motor-driven wireframe has the above-described electric device. The motor of the electric device is attached to the fixed part of the motor-driven wireframe by its housing. The non-fixed support of the electric device is connected to the movable part of the motor-driven wireframe so that the movable part act or move.

Not only can the Christmas wireframe of the present invention illuminate, but it can also act flexibly, so it is vivid and draws people's attention.

DETAILED DESCRIPTION OF THE INVENTION

Figure 1:
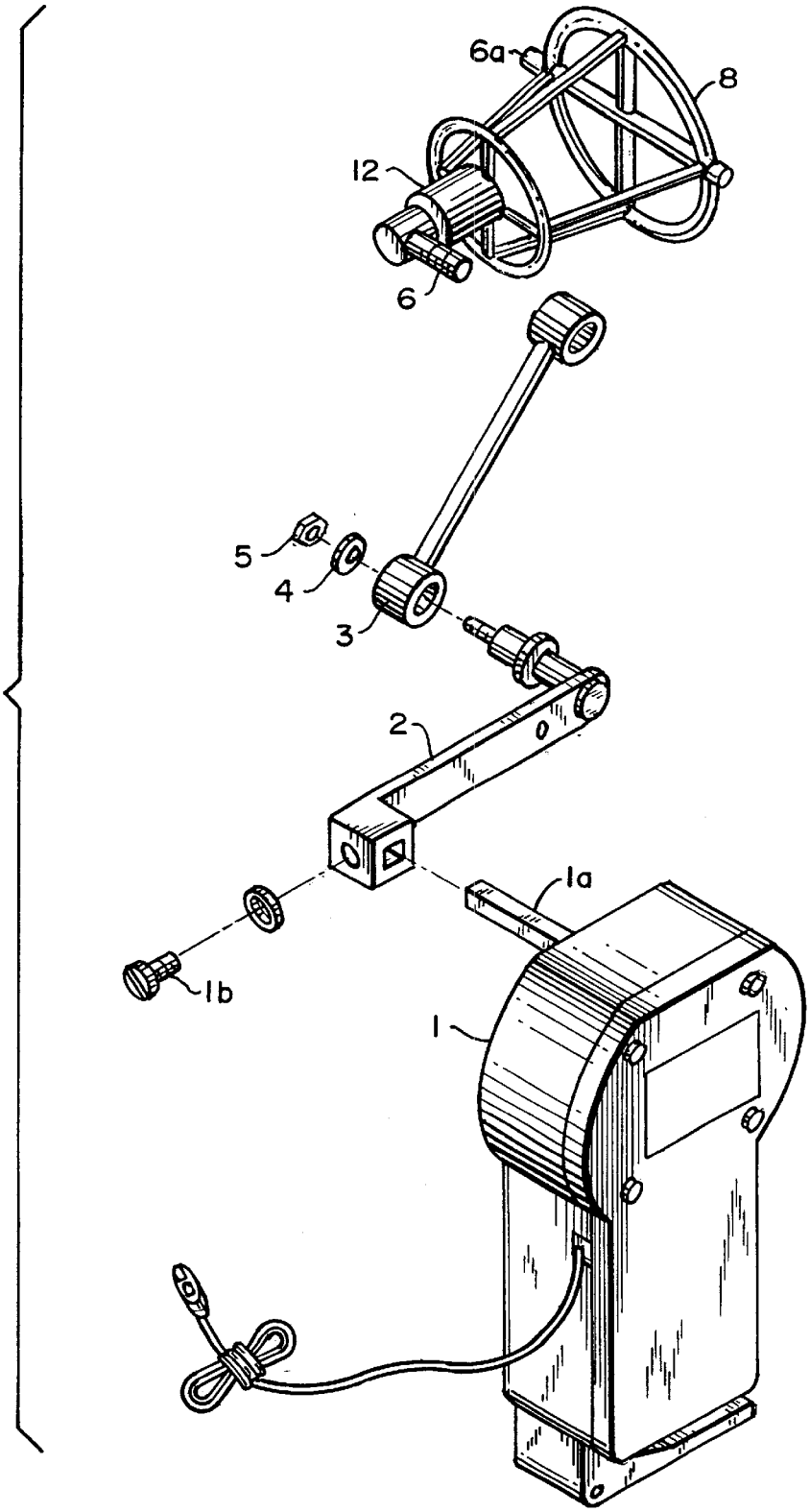
FIG. 1 is a perspective view of a first power-driven device of the present invention, in which an electric device with no wireframe arranged is shown.

Referring to the power-driven device of the present invention shown in FIG. 1, its structure includes a motor 1 a shaft 2 directly connected to the motor 1. Shaft 2 is connected to rotating shaft 1*a* of motor 1 with screw 1*b*. Shaft 2 is connected to guide lever 3, which is an intermediate mechanism that is also connected to final movable axle 6. A washer 4 and a screw nut 5 are used for fixing the movable connection between guide lever 3 and shaft 2. Final movable axle 6 is connected to balance weight 12. Balance weight 12 provides for smoother and more lifelike movement of the animated wireframe. Balance weight 12 is connected to non-fixed support 8. Non-fixed support 8 has pivot axle 6*a*, which movably connects to the wireframe to allow up and down movement of a portion of the wireframe. Motor 1 is described in U.S. patent application Ser. No. 09/458,325 which is hereby incorporated by reference.

Figure 2:
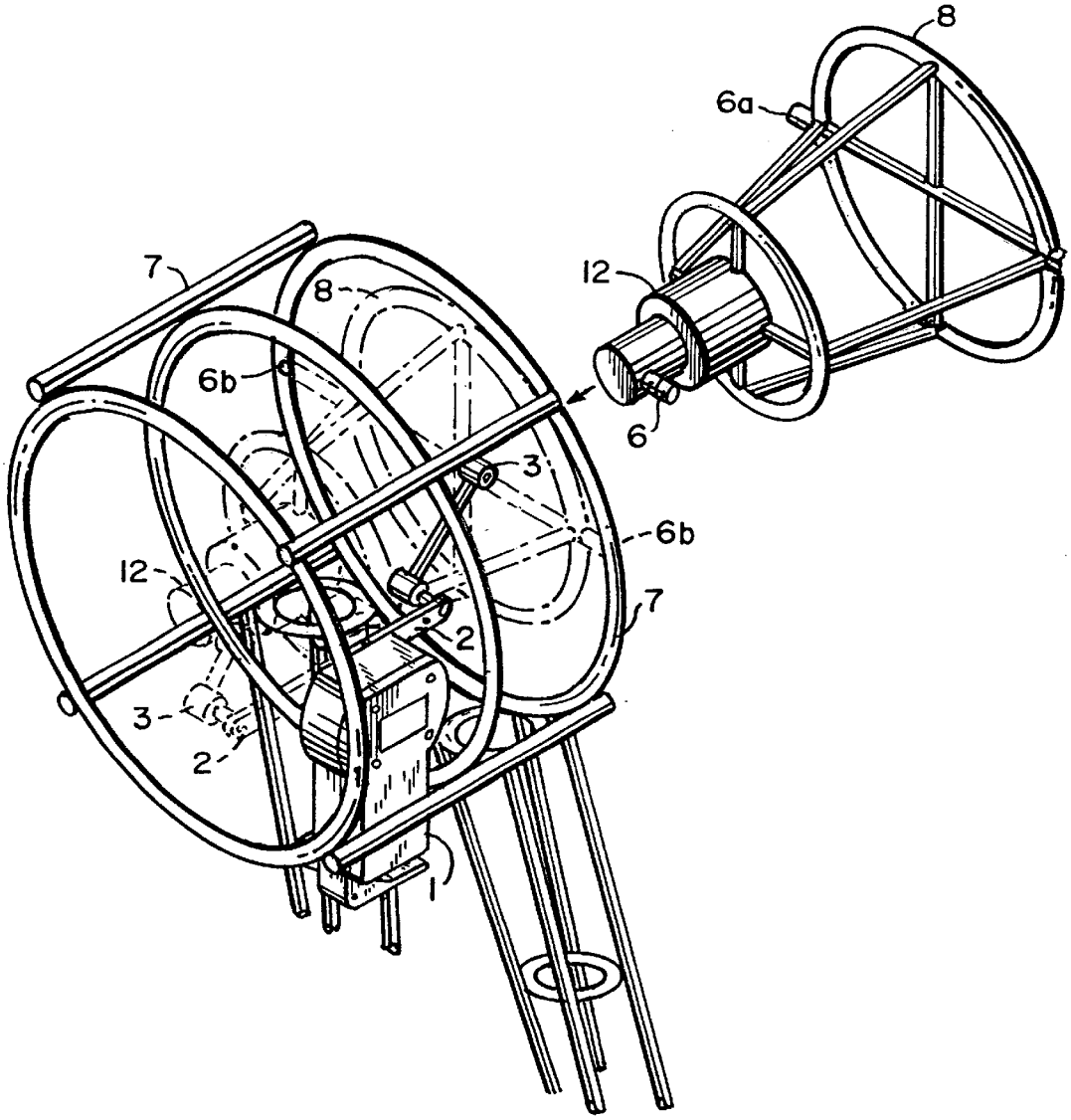
FIG. 2 is a perspective view showing the device in FIG. 1 attached to a first embodiment of the wireframe.
Figure 3:
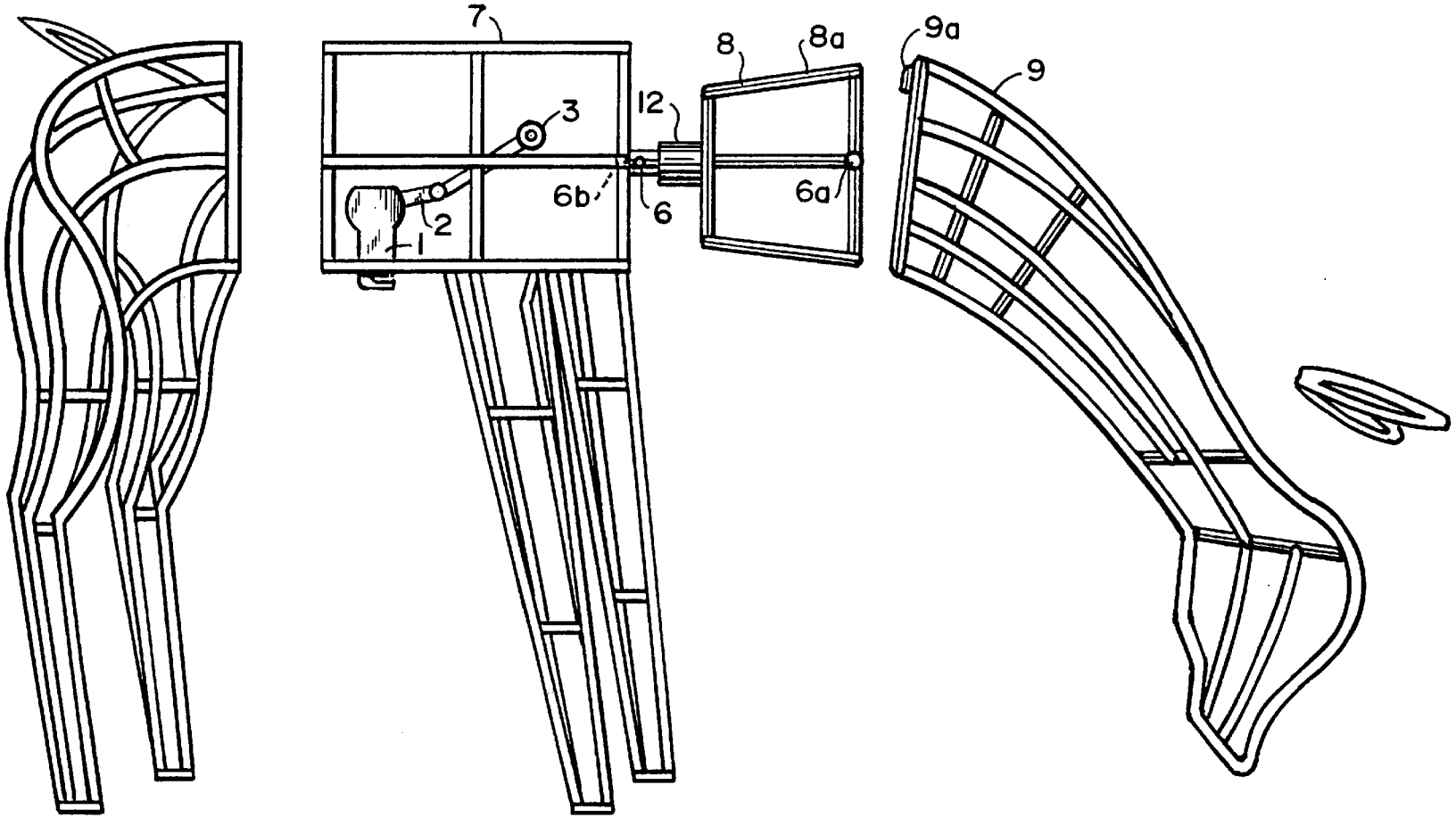
FIG. 3 is an exploded view showing the wireframe of FIG. 2.

FIG. 2 shows the condition that the electric device shown in FIG. 1 has been arranged on wireframe 7, which forms a part of the body of the animal-like structure. Particularly, final movable axle 6 and balance weight 12 are attached to non-fixed support 8. Non-fixed support 8 can be arranged on wireframe 7 in a non-fixed state by movably placing pivot axle 6*a* in recepticles 6*b* located on or in wireframe 7. This allows for up and down movement of non-fixed support 8. FIG. 3 mainly shows the condition of decomposition of the parts shown in FIG. 2, as well as movable part 9. Movable part 9 is connected to non-fixed support 8 with connector 9*a*. Connector 9*a* is adapted to connect to support bar 8*a* of non-fixed support 8. By way of example, connector 9*a* may be an inverted U-shape (not shown) such that the inverted U-shaped connector is placed over support bar 8*a* so that support bar 8*a* rests in the curved portion of the inverted U-shaped connector.

Figure 4:
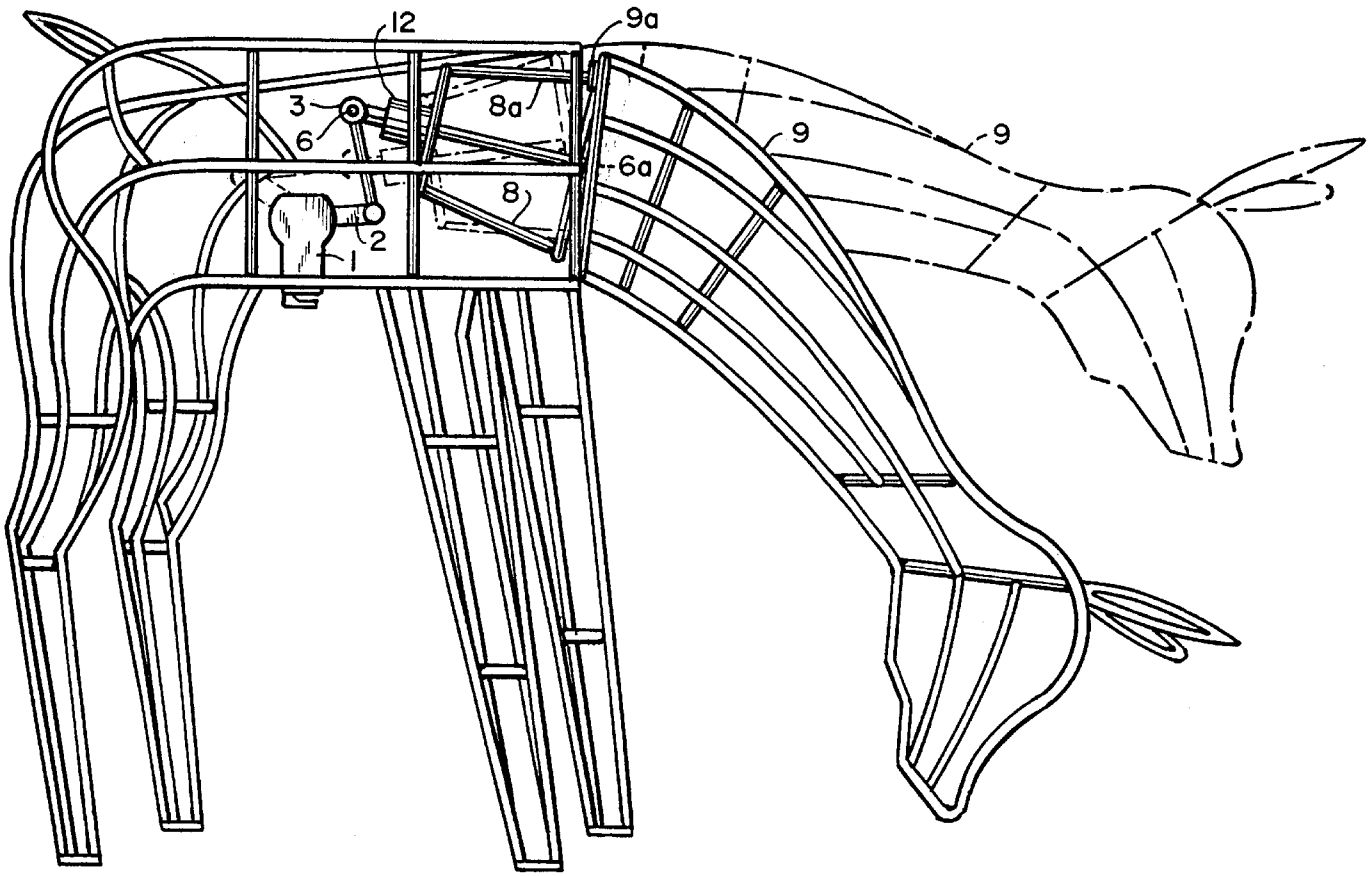
FIG. 4 is an overall plan view showing the first embodiment of the wireframe of the present invention that is capable of up and down movement.

Referring to FIG. 4, in a first embodiment, the motor-driven wireframe appears generally animal-like and comprises a fixed part with a body and four limbs, and movable part 9 with a neck and a head. Motor 1 of the electric device is attached to the fixed part of the wireframe by its housing. Non-fixed support 8 of the electric device is pivotably connected to the wireframe via pivot axle 6*a* and recepticles 6*b* (not shown). Non-fixed support 8 is connected to movable part 9 via connector 9*a* which rests upon support bar 8*a*, as set forth above. When the power supply is turned on, motor 1 is enabled to rotate shaft 2, which in turn rotates guide lever 3 . When guide lever 3 rotates, it causes final shaft 6 and balance weight 12 to move up and down. The movement of final shaft 6 and balance weight 12 causes non-fixed support 8 and movable part 9 to move accordingly. As shown in FIG. 4, movable part 9 (i. e., the neck and head part of the whole animal-like wireframe) makes up-and-down movement.

Figure 5:
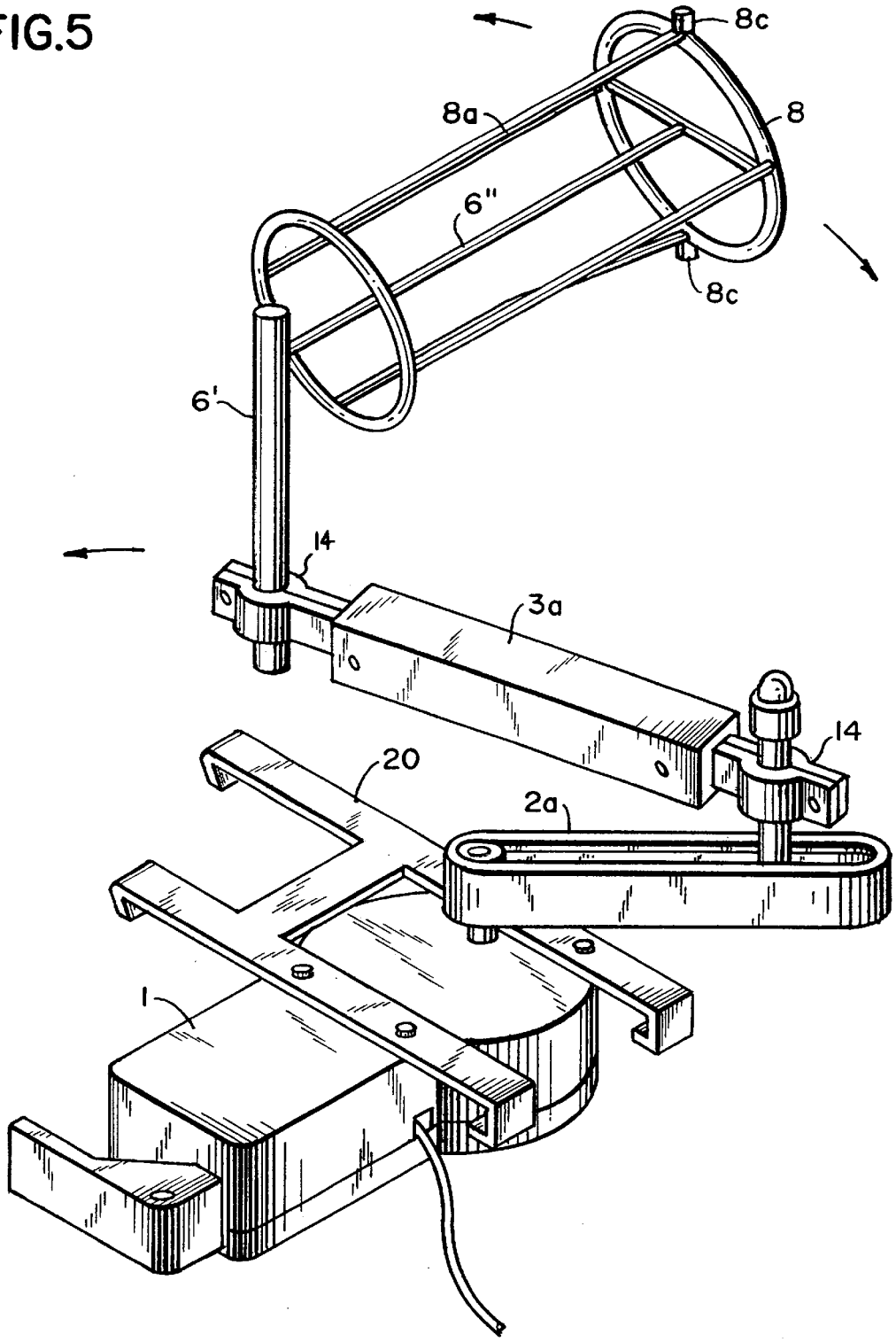
FIG. 5 is a perspective view of a second power-driven part of the present invention, in which an electric device with no wireframe arranged is shown.

In a second embodiment of the power-driven device of the present invention, shown in FIG. 5, non-fixed support 8 is adapted for side-to-side movement. Non-fixed support 8 is connected to final shaft or axle 6' via connecting rod 6". Non-fixed support 8 includes support rod 8*a* and pivot rods 8*c*, which allow for side-to-side movement of the movable part of the wireframe. Guide lever 3*a* further includes bearings 14 to enable smooth rotation of final shaft 6' and motor shaft 2*a* within the guide lever. Motor 1 further includes a mounting bracket 20 for affixing the motor to the fixed part of the 30 wireframe.

Figure 6:
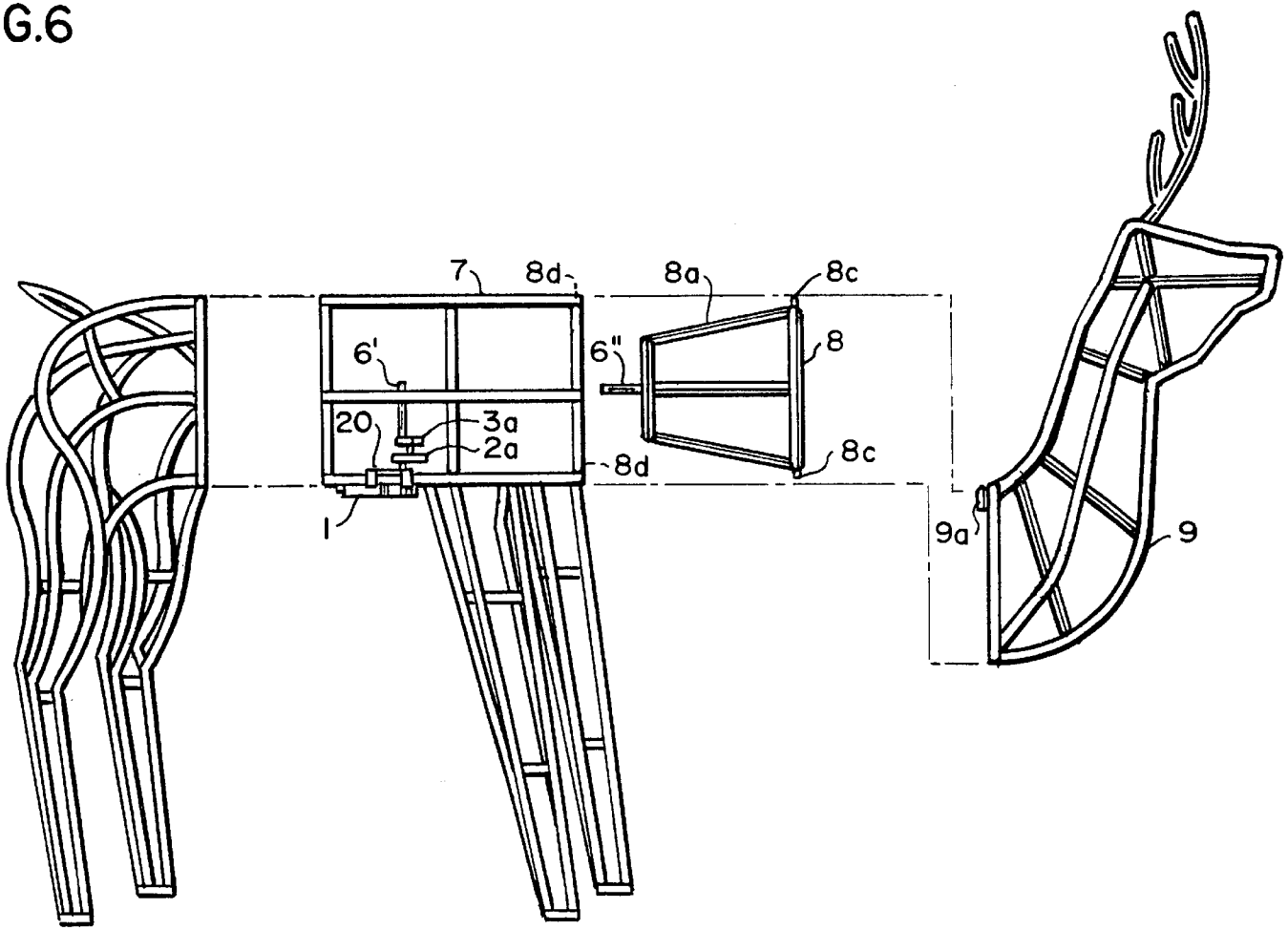
FIG. 6 is an exploded view showing a second wireframe of the present invention.
Figure 7:
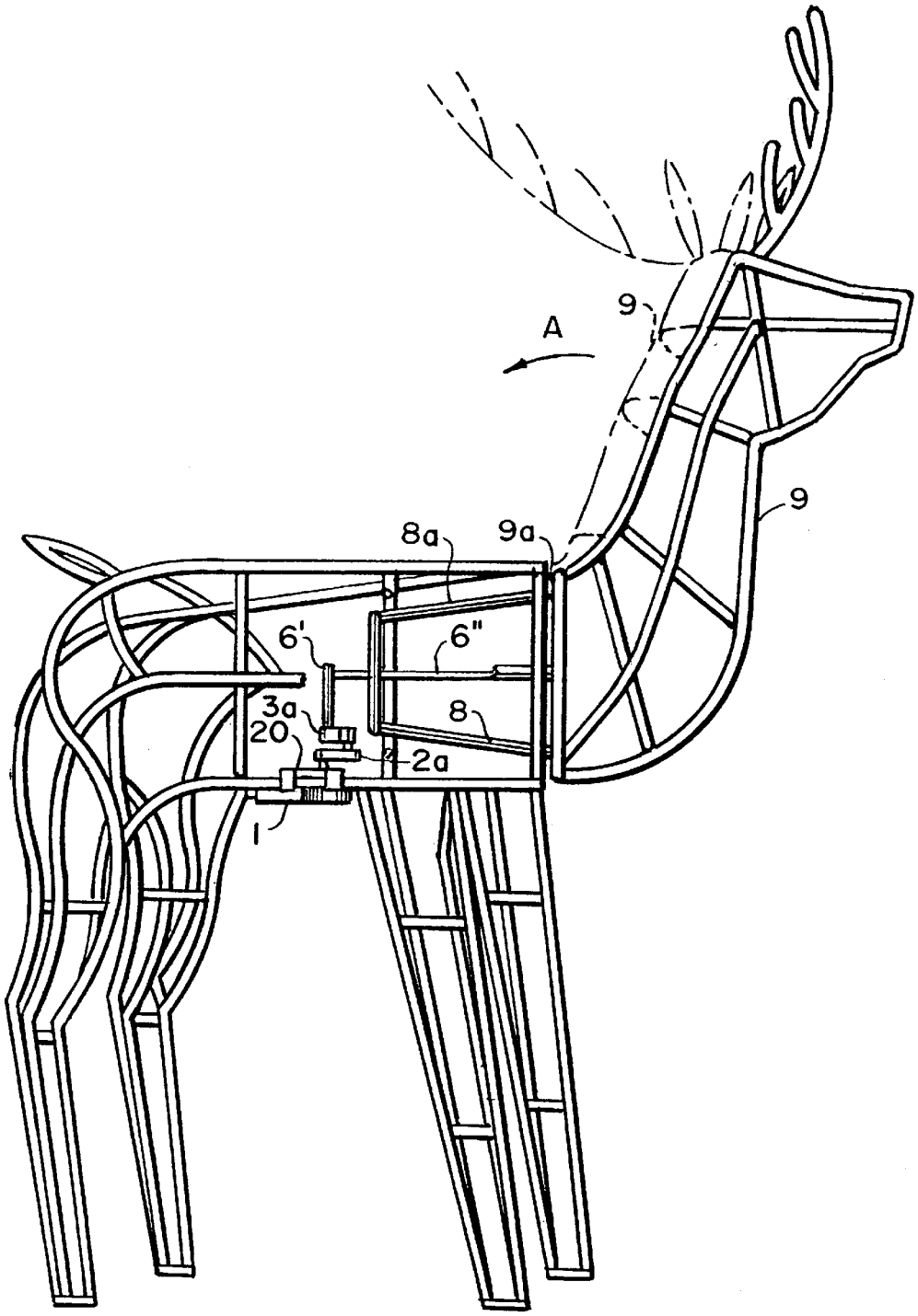
FIG. 7 is a partial plan view showing the wireframe of FIG. 6, which is capable of side-to-side movement.

A preferred embodiment of the wireframe of the present invention, adapted for use with the power-driven device of FIG. 5, is shown in FIGS. 6 and 7. Motor 1 is mounted to a fixed part of wireframe 7 by mounting bracket 20 such that when activated, guide lever 3*a* rotates in a manner that causes final shaft 6', and subsequently non-fixed support 8 and movable part 9 to move side-to-side. Non-fixed support 8 is pivotably connected to wireframe 7 by placing pivot rods 8*c* in recepticles 8*d*, which allow pivot rods 8*c* to freely pivot. Movable part 9 is connected to non-fixed support 8 via connector 9*a*, as described above for FIGS. 3 and 4.

When the power supply is turned on, motor 1 is enabled to rotate shaft 2*a*, which in turn rotates guide lever 3*a*. When guide lever 3*a* rotates, it causes final shaft 6' to move side-to-side. The side-to-side movement of final shaft 6' causes non-fixed support 8 and movable part 9 to move accordingly. As shown in FIG. 7, movable part 9 (i. e., the neck and head part of the whole animal-like wireframe) makes side-to-side movement as shown by arrow A.

Figure 8:
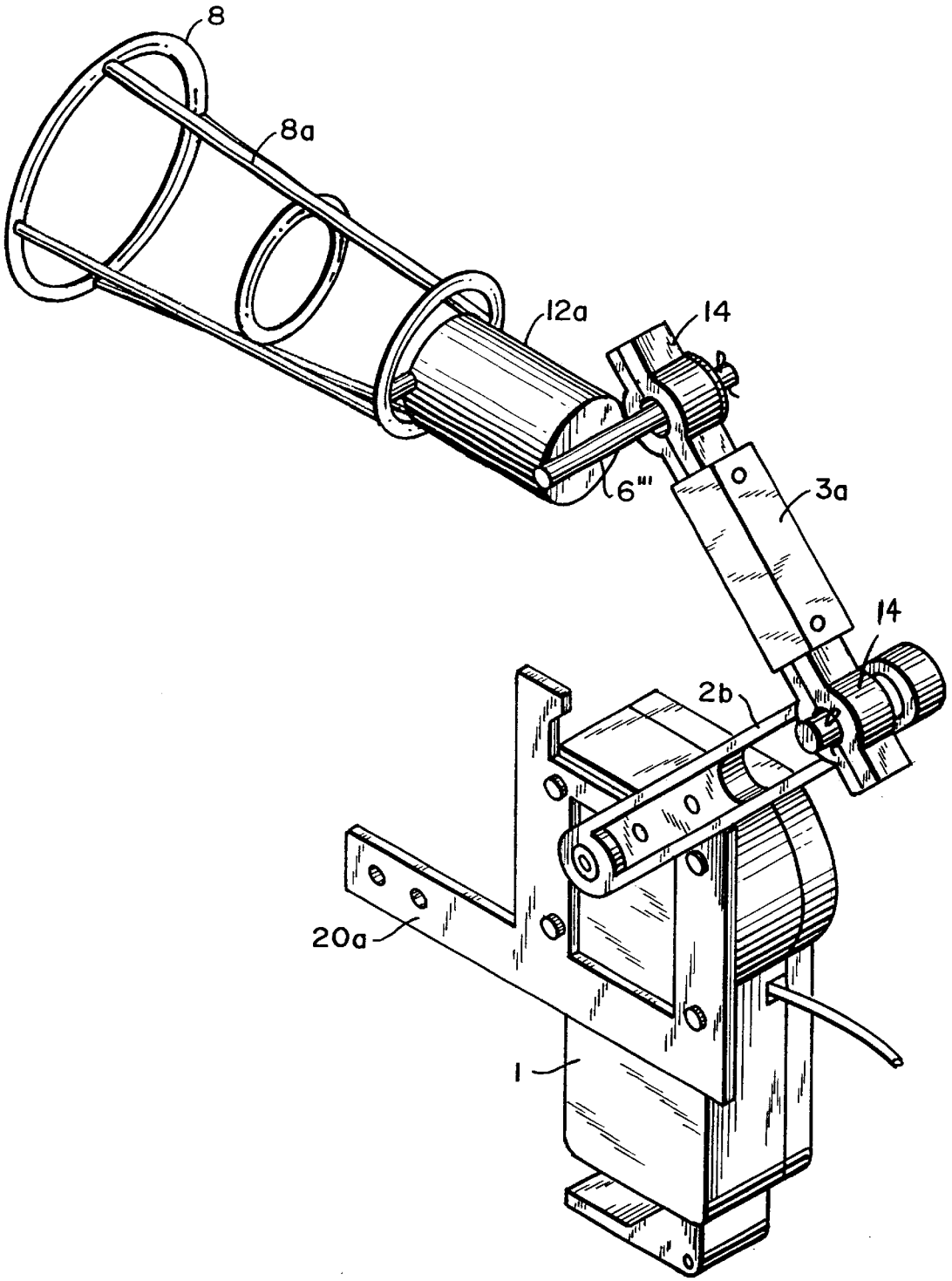
FIG. 8 is a perspective view of a third embodiment of the power-driven device of the present invention.

In a third embodiment of the power-driven device of the present invention, shown in FIG. 8, non-fixed support 8 further includes balance weight 12*a* disposed between the end of non-fixed support 8 and final shaft 6'". Balance weight 12*a* provides for smoother and more lifelike movement of movable part 9. Guide lever 3*a* further includes bearings 14 to enable smooth rotation of final shaft 6'" and shaft 2*b* within guide lever 3*a*. Non-fixed support 8 also includes support rod 8*a* for receiving the connecting means of the movable part (not shown). Motor 1 further includes a mounting bracket 20*a* for affixing the motor to the fixed part of the wireframe. This embodiment is adapted for use in either side-to-side or up-and-down movement of non-fixed support 8, as described above. As such, non-fixed support 8 may further include a pivot axle or pivot rods, as described above, depending on the direction of movement desired.

Figure 9:
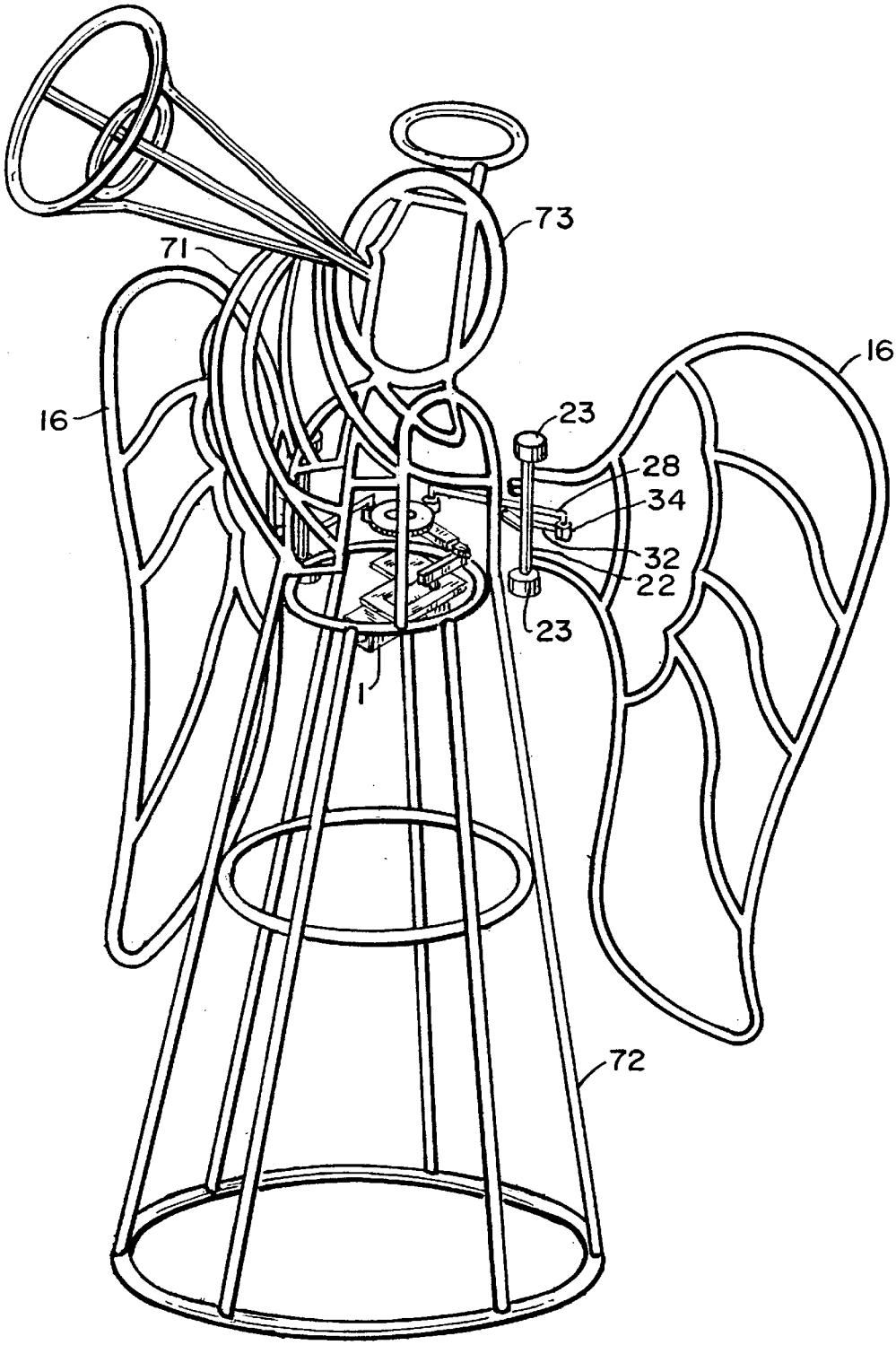
FIG. 9 is an overall perspective view showing a third embodiment of the wireframe of the present invention.
Figure 10:
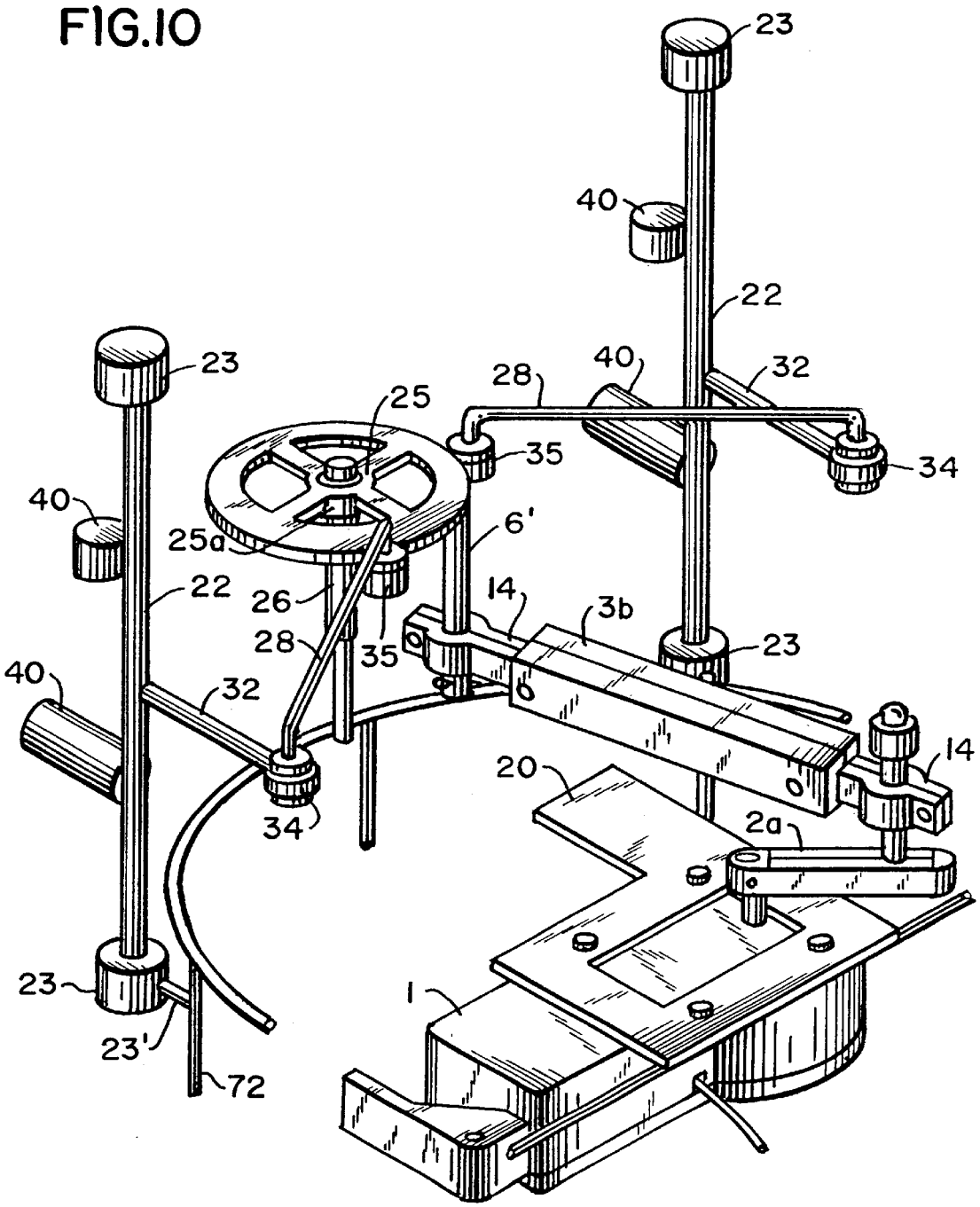
FIG. 10 is a perspective view of the power-driven device of the embodiment of FIG. 9.

In a third embodiment of the wireframe of the present invention, shown in FIG. 9, the motor-driven wireframe appears generally angel-like. It comprises a fixed part with two arms 71, body 72, head 73, and movable parts 16, which appear wing-like. In this embodiment, movable parts 16 are adapted to move front to back in relation to the angel-like wireframe to give the appearance of flapping. The power-driven device of the angel-like wireframe is shown in FIG. 10. Its structure includes motor 1, mounting bracket 20, and shaft 2*a*. Motor 1 is affixed to body 72 via mounting bracket 20. Shaft 2*a* is directly connected to motor 1 with shaft 2*a* being further connected to guide lever 3*b*. Guide lever 3*b* is an intermediate mechanism connected to shaft 2*a* and final movable axle or shaft 6'. Guide lever 3*b* also has bearings 14 to enable smooth rotation of movable axle 6' and shaft 2*a* within guide lever 3*b*. Final movable axle 6' is fixed upon cam 25 parallel to the axis of rotation of the cam.

Cam 25 is rotatably fixed on bearing 25*a* of support 26 of fixed body 72. Cam 25 has a pair of bushings 35 affixed thereto. Bushings 35 are offset from one another along the circumference of cam 25. Bushings 35 are adapted to rotatably affix members 28 to cam 25. Members 28 have bushings 34 affixed thereto. Bushings 34 are adapted to rotatably affix driver arms 32 to members 28.

A pair of wing rods 22 are rotatably connected to bearings 23, which are affixed to body 72 at rods 23'. Wing rods 22 are parallel to one another and are parallel to the axis of rotation of cam 25. Wing rods 22 have driver arms 32 affixed perpendicular thereto. Wing rods 22 further include connectors 40 for removably affixing movable parts 16 thereto.

In use, power is applied to motor 1. Motor 1 rotates shaft 2*a*, which in turn rotates guide lever 3*b*. Guide lever 3*b* drives final shaft 6' and thus rotates cam 25. The rotation of cam 25 imparts an eccentric rotational movement to members 28. The movement of members 28 causes driver arms 32 to rotate wing rods 22 in a back-and-forth motion. Thus, movable parts 16, removably affixed to wing rods 22 at connectors 40, appear to move in a flapping motion.

The present invention may also include bulbs. As a result, a wireframe that not only illuminates, but also moves, is formed.

With reference to the drawings, an embodiment of the present invention is described above, it should be understood that it merely belongs to example, the present invention is not limited to the above example, various changes, improvements or modifications can be made without departing from the scope of the spirit of the present invention. The protection scope of the present invention is defined by the attached claims.

What is claimed is:

1. An electric device for a wireframe comprising:

a motor;

a shaft connected to and driven by the motor;

a guide lever having a first end and a second end, said first end being movably connected to said shaft, said second end being movably connected to a movable axle, said movable axle having a non-fixed support arranged thereon; and a balance weight fixed between said movable axle and said non-fixed support.

2. The electric device of claim 1, further comprising:

a pivot axle on said non-fixed support, wherein said non-fixed support moves up and down in response to said motor.

3. The electric device of claim 1, further comprising:

a first bearing at said first end of said guide lever for movably connecting said shaft to said guide lever;

a second bearing at said second end of said guide lever for movably connecting said movable axle to said guide lever; and pivot rods on said non-fixed support, wherein said non-fixed support moves side-to-side in response to said motor.

4. A motor-driven wireframe of a general animal-like appearance comprising:

a fixed part with a body having a first limb, a second limb, a third limb, and a fourth limb;

a movable part having a neck and a head; and an electric device comprising:

a motor with a motor housing;

a shaft connected to and driven by said motor;

a guide lever having a first end and a second end, said first end being movably connected to said shaft, said second end being movably connected to a movable axle, said movable axle having a non-fixed support arranged thereon, wherein said motor is connected to said fixed part of said motor-driven wireframe by said housing and said non-fixed support is connected to said movable part so that said movable part moves in response to said motor.

5. The motor-driven wireframe according to claim 4, wherein said motor-driven wireframe includes a plurality of bulbs arranged on said wireframe, whereby said bulbs illuminate when connected with a power source.

6. The motor-driven wireframe according to claim 4, further comprising:

a balance weight fixed between said movable axle and said non-fixed support; and a pivot axle on said non-fixed support, wherein said movable part moves up and down in response to said motor.

7. The motor-driven wireframe according to claim 4, further comprising:

a first bearing at said first end of said guide lever for movably connecting said shaft to said guide lever;

a second bearing at said second end of said guide lever for movably connecting said movable axle to said guide lever; and pivot rods on said non-fixed support, wherein said movable part moves side-to-side in response to said motor.

8. A motor-driven wireframe of a general angel-like appearance comprising:

a fixed part with a body having a first limb, a second limb, a third limb, a fourth limb;

movable parts of a general wing-like appearance; and an electric device comprising:

a motor with a motor housing;

a shaft connected to and driven by said motor;

a guide lever having a first end and a second end, said first end being movably connected to said shaft, said second end being movably connected to a final axle; and a cam having a bearing, said final axle being connected to said cam, wherein said motor is connected to said fixed part of said motor-driven wireframe by said housing and said cam is connected to said movable parts so that said movable parts move in response to said motor.

9. The motor-driven wireframe according to claim 8, wherein said motor-driven wireframe includes a plurality of bulbs arranged on said wireframe, whereby said bulbs illuminate when connected with a power source.

10. The motor-driven wireframe according to claim 8, further comprising:

a first connector having a first end and a second end, said first end having a first blushing and said second end having a second blushing;

a second connector having a first end and a second end, said first end having a first blushing and said second end having a second blushing;

a first driver arm having a first end connected to said second blushing of said first connector and a second end connected to a first wing rod; and a second driver arm having a first end connected to said second blushing of said second connector and a second end connected to a second wing rod;

wherein said wing rods are connected to said movable parts and said movable parts move side-to-side in response to said motor thereby providing the appearance of flapping to said movable parts.

* * * * *